US010322418B2

(12) United States Patent
Urick

(10) Patent No.: US 10,322,418 B2
(45) Date of Patent: Jun. 18, 2019

(54) MAGNETIC SEPARATOR APPARATUS

(71) Applicant: David Urick, Camas, WA (US)

(72) Inventor: David Urick, Camas, WA (US)

( * ) Notice: Subject to any disclaimer, the term of this patent is extended or adjusted under 35 U.S.C. 154(b) by 3 days.

(21) Appl. No.: 15/732,099

(22) Filed: Sep. 18, 2017

(65) Prior Publication Data

US 2018/0093279 A1 Apr. 5, 2018

Related U.S. Application Data

(60) Provisional application No. 62/496,083, filed on Oct. 4, 2016.

(51) Int. Cl.

| | |
|---|---|
| ***B03C 1/06*** | (2006.01) |
| ***B03C 1/30*** | (2006.01) |
| ***B07B 1/52*** | (2006.01) |

(52) U.S. Cl.

CPC ..... *B03C 1/06* (2013.01); *B03C 1/30* (2013.01); *B07B 1/526* (2013.01); *B03C 2201/20* (2013.01)

(58) Field of Classification Search

CPC .... B03C 1/30; B03C 1/06; B03C 1/03; B03C 1/247; B03C 2201/00; B03C 2201/20; B07B 1/50; B07B 1/52; B07B 1/526

See application file for complete search history.

(56) References Cited

U.S. PATENT DOCUMENTS

| | | | | |
|---|---|---|---|---|
| 954,015 | A | 4/1910 | Bent | |
| 4,416,771 | A | 11/1983 | Henriques | |
| 4,512,881 | A | 4/1985 | Shumway | |
| 4,743,364 | A | 5/1988 | Kyrazis | |
| 5,632,720 | A | 5/1997 | Kleitz | |
| 6,138,833 | A | 10/2000 | Matsufuji | |
| 6,230,897 | B1 * | 5/2001 | Exner | B03C 1/247 209/212 |
| 7,886,913 | B1 * | 2/2011 | Fritz | B03C 1/247 209/214 |
| 8,684,185 | B2 | 4/2014 | Ries | |
| 2016/0001299 | A1 * | 1/2016 | Johns | B03C 1/0332 209/39 |

* cited by examiner

*Primary Examiner* — Joseph C Rodriguez
*Assistant Examiner* — Kalyanavenkateshware Kumar
(74) *Attorney, Agent, or Firm* — Randal Homburg

(57) ABSTRACT

A magnetic separator apparatus for the removal of magnetic particles from gold bearing sands provides one or more magnetic separator assemblies along a sluice box channel to remove the magnetic particles using spinning strong earth magnets within a magnetic separator assembly, removing the magnetic particle where they are removed from the apparatus and evacuated as waste, while the valuable non-magnetic particles are left within the sluice for further separation, classification and processing to remove the precious metal particles contained therein, the apparatus used in a wet or dry application.

4 Claims, 5 Drawing Sheets

MAGNETIC SEPARATOR APPARATUS

CROSS REFERENCE TO RELATED APPLICATIONS

Applicant claims the benefit of Provisional Patent No. 62/496,083, filed by the same inventor on Oct. 4, 2016.

1. BACKGROUND OF THE INVENTION

1. Field of Invention

A multiple point separation apparatus for the removal of magnetic particles from gold bearing sands provides one or more magnetic separator assemblies along a sluice channel to remove the magnetic particles using a spinning strong magnet within a channel platform, removing the magnetic particle where they are scraped from the platform and directed to an evacuation slot where they are disposed of as waste, while the non-magnetic particles are left within the sluice for further separation and processing to remove the precious metal particles contained therein. The apparatus may be used as a wet or dry sluice.

2. Description of Prior Art

A preliminary review of prior art patents was conducted by the applicant which reveal prior art patents in a similar field or having similar use. However, the prior art inventions do not disclose the same or similar elements as the present magnetic separator, nor do they present the material components in a manner contemplated or anticipated in the prior art.

Magnetic separation of ore has been used for ore suspended is liquids or for the application to dry ores materials. In U.S. Pat. No. 954,015 to Bent, an auger compels a stream of liquid bearing ore through a horizontal tube with a magnet drawing the magnetic particles laterally where the magnetic particles are evacuated in a descent while the tailings in the suspension are carried upward by an upward flowing stream. A vertical separator sifts ore through a mesh screen where the particles fall into an upper cylinder into a liquid within the tube pushed by an eddy current within the tube influenced by a DC biased current and forces the particles into lateral multiple ore extractors which gather the metallic ores and extract them based upon their distinct permeability and ohmic resistance. See U.S. Pat. No. 4,416,771 to Henriquez. The cores are charged with an alternating current of variable frequencies. "Influenced particles" are moved aside while "uninfluenced particles" continue downward into the bottom of the vertical tube. A similar liquid suspension separator is shown in U.S. Pat. No. 8,684,185 to Ries which uses a magnetic coil to influence magnetic particles away from non-magnetic particle within a mixture of magnetic and non-magnetic particles within the liquid suspension.

U.S. Pat. No. 4,743,364 to Kyrazis runs a mixed power by means of a belt drive through a magnetic field, wherein the magnetic particles are lifted into an upper passage while a lower passage evacuates the non-magnetic particle not influenced by the magnetic field.

Rotation has also been used in the separation of metallic ores. In U.S. Pat. No. 6,138,833 to Matsufuji, a method is defined which utilizes centrifugal force provided by an air jet pump to move placer gold sand particles through a pipe and removing the particles through the specific gravity distinctions of the particles and separating the placer gold from the other particles through a magnetized cylinder with a high magnetic field, between 5000 and 200,00 gauss, against an inner wall of the magnetized cylinder. A much more simple rotating cylinder is shown in U.S. Pat. No. 4,512,881 to Shumway, which is a simple rotating drum cylinder with an inner spiral auger with large particles sent down the rotating drum while the smaller gold containing black sands are released through a plurality of small openings in the drum allowing the black sand to be separated from the more course materials in the materials run through the drum. A vibrating cradle is also employed within the machine.

A rotating magnetic wand is demonstrated in an unrelated massage device to Kleitz, U.S. Pat. No. 5,632,720, which discloses a wand with an inner rotating magnet which emits an series of magnetic waves which allegedly enhance vascular circulation when held over a body part between 18 and 24 inches away from the body part. Although used in a wholly unrelated field of art, it does include a wand with a rotating magnet within the wand.

II. SUMMARY OF THE INVENTION

Black sand gold mining has grown in popularity due to the recent increase in the price of gold and the development of less expensive technology for the part time prospector and enthusiast. Black sands are found in several geographic locales across the globe, primarily in places containing placer deposits or on beaches near prior volcanic activity. The black sands are known to contain precious metals including gold, thorium, titanium, tungsten, and zirconium, and gemstones including garnet, topaz, ruby, sapphire, and diamonds. Due to the increase in the occasional prospectors, large scale placer mining has been restricted, commonly requiring a license or permit near lakes, rivers and streams and especially on public beaches. Small scale or hobby scale mining has also been recently restricted or limited to small quantity mining and often away from the water where the black sands are know to deposit.

As seen in the prior art, using a magnet for primary separation of magnetic deposits from non-magnetic materials has been known in the field of placer mining of black sands. However, none of the prior art provides a magnetic separator using the simple components and mechanical features of the present magnetic separator apparatus.

The primary objective of the invention is to provide a simple device attaching to a local power supply which attracts magnetic materials comprising black sands passing through a wet or dry sluice and, by use of a spinning motion, causes the magnetic particles to be forcibly removed from the non-magnetic material by inertia and/or centrifugal force and further evacuated from the mixtures. A second objective is to provide the apparatus to withdraw the magnetic material and to adapt for a wet or dry mixture of materials, allowing the non-magnetic materials to pass through the sluice for further classification and separation. Unlike the previously patented device by the same inventor, which was a hand held version of the same type concept, the present invention is provided for an industrial and commercially applied apparatus using a local drive means and incorporated as a component in industrial sized applications and machinery where separation of magnetic particles is desire and useful.

III. DESCRIPTION OF THE DRAWINGS

The following drawings are informal drawings submitted with this provisional patent application.

IV. DESCRIPTION OF THE PREFERRED EMBODIMENT

Figure 1:
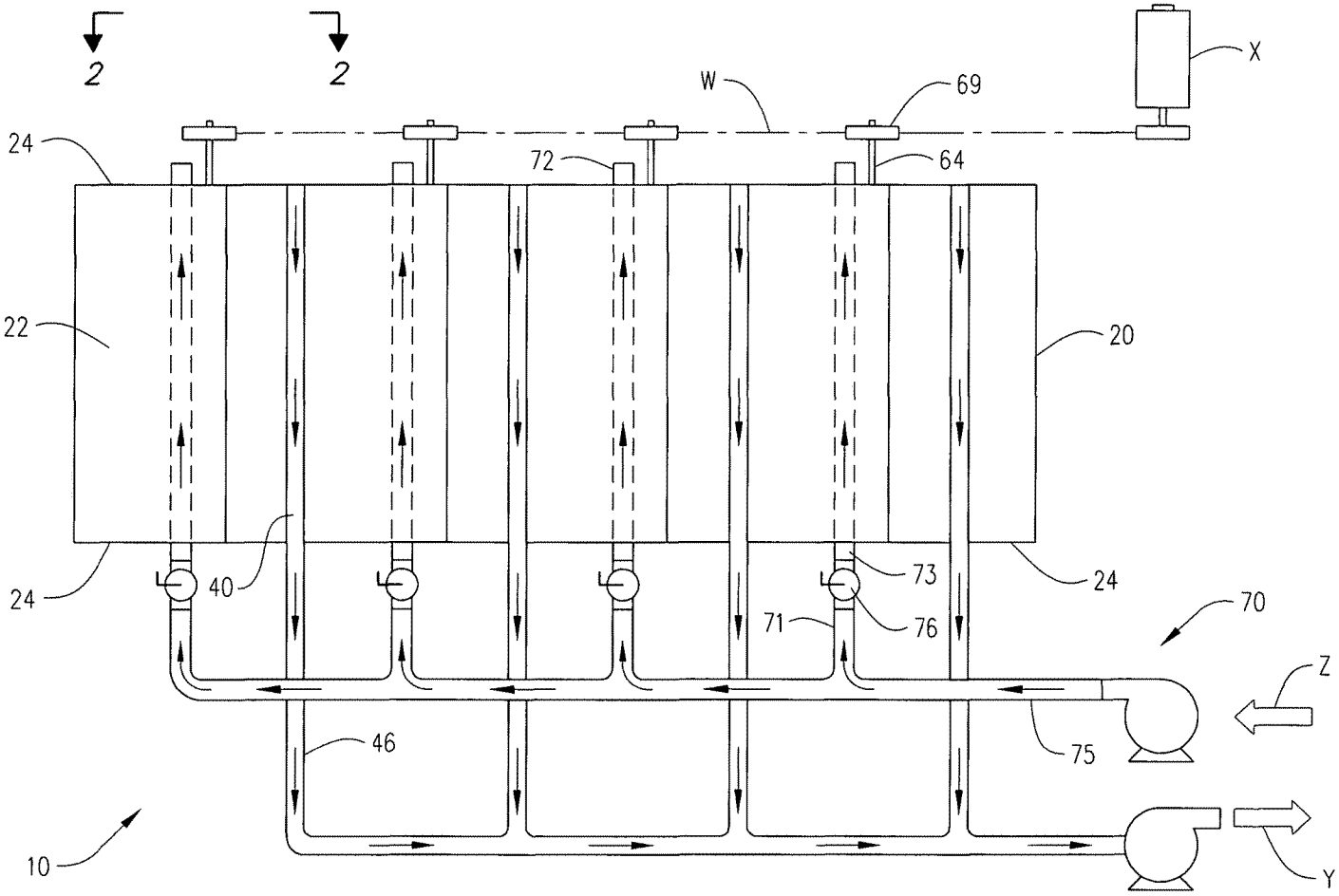
FIG. 1 is a top view of the magnetic separator apparatus using four magnetic separator assemblies above the sluice box, with a broken line depicting a common drive belt from a local power supply.

A magnetic separator apparatus 10 for the removal of magnetic particulate materials A from gold bearing sands B and passing valuable non-magnetic gold bearing materials C along the apparatus without removal, applied to wet or dry use, provides a section of sluice box 20 defining a lower flat tray 22 and a pair of lateral sides 24 between which is installed at least one magnetic separator assembly 30. In FIG. 1, the apparatus 10 provides a series of four magnetic separator assemblies 30, all being operated by a common drive X.

Figure 2:
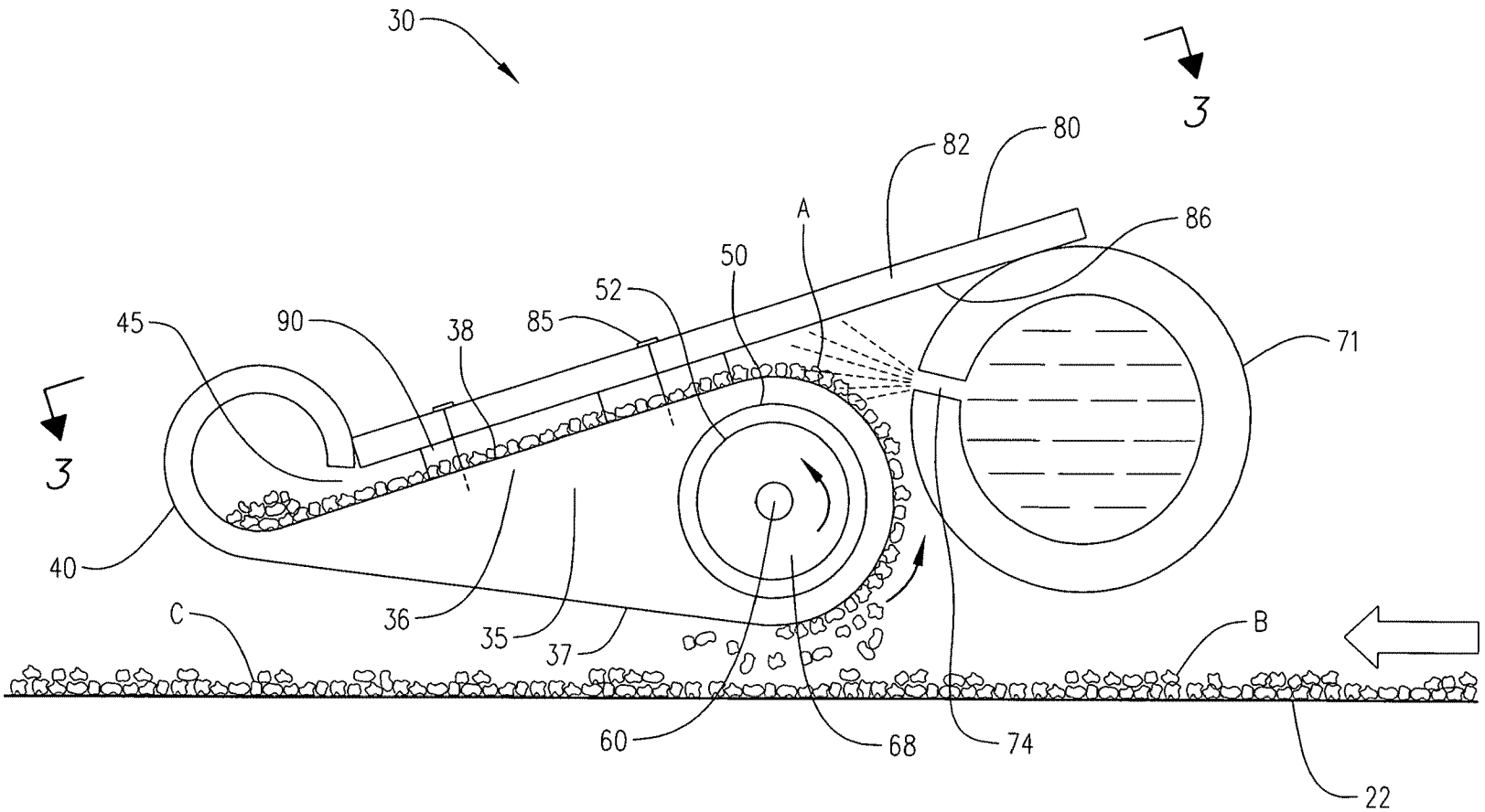
FIG. 2 is a side view of a single magnetic separator assembly processing granular materials along section lines 2/2 of FIG. 1.
Figure 4:
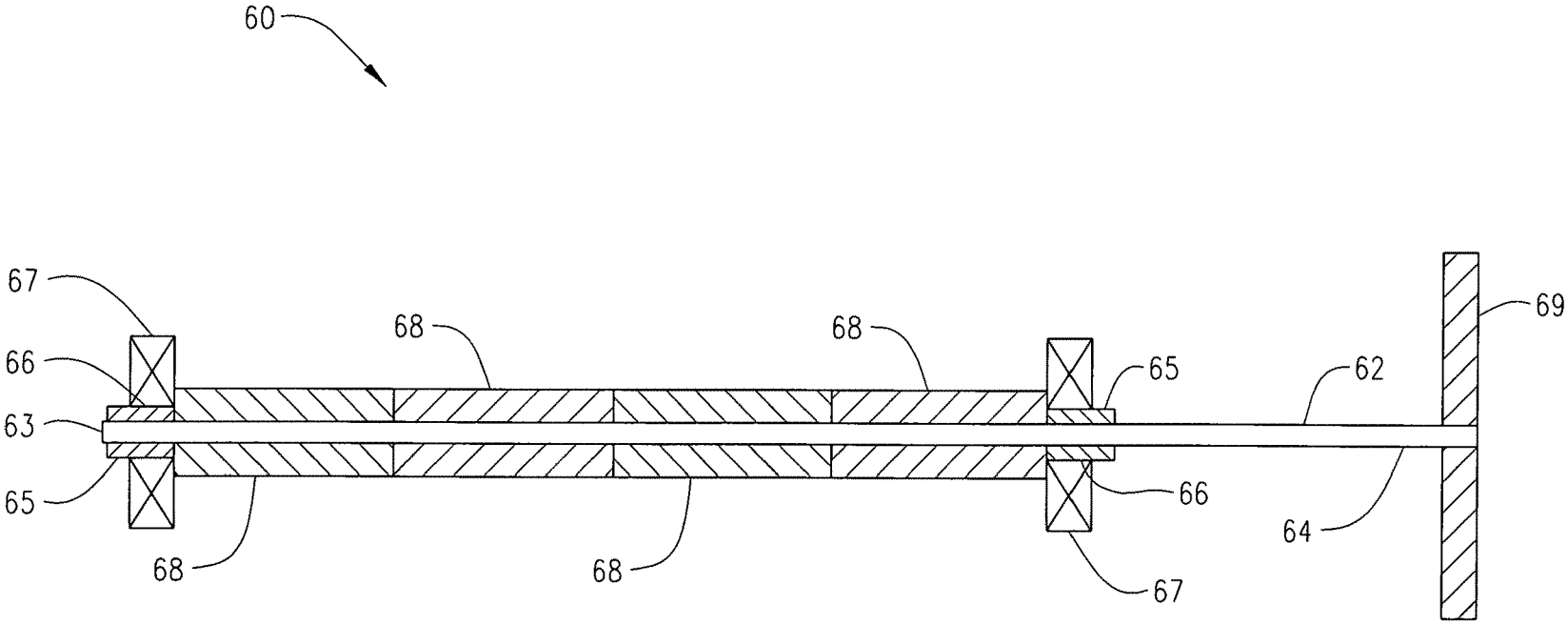
FIG. 4 is a top sectional view of a single magnetic separator assembly along section lines 4/4 of FIG. 3.

Each magnetic separator assembly 30, FIGS. 2 and 4, further comprises a non-magnetic formed plate 35 defining a lower surface 37, an evacuation cylinder 40 having a lower break 45 cooperating across an upper surface 38 of a middle planar portion 36, and a magnetic cylinder tube 50 defining a magnetic cylinder chamber 52, defining opposing open ends 54. The evacuation cylinder 40 forms a closed end 47 and an open end 48. An evacuation hose 46 attaches to the open end 48 which further attaches to a vacuum source Y through a lateral side 24 of the sluice box 20 to withdraw magnetic particulate materials A received through the lower break 45 into the evacuation cylinder 40 as received during operation of the apparatus 10.

Figure 3:
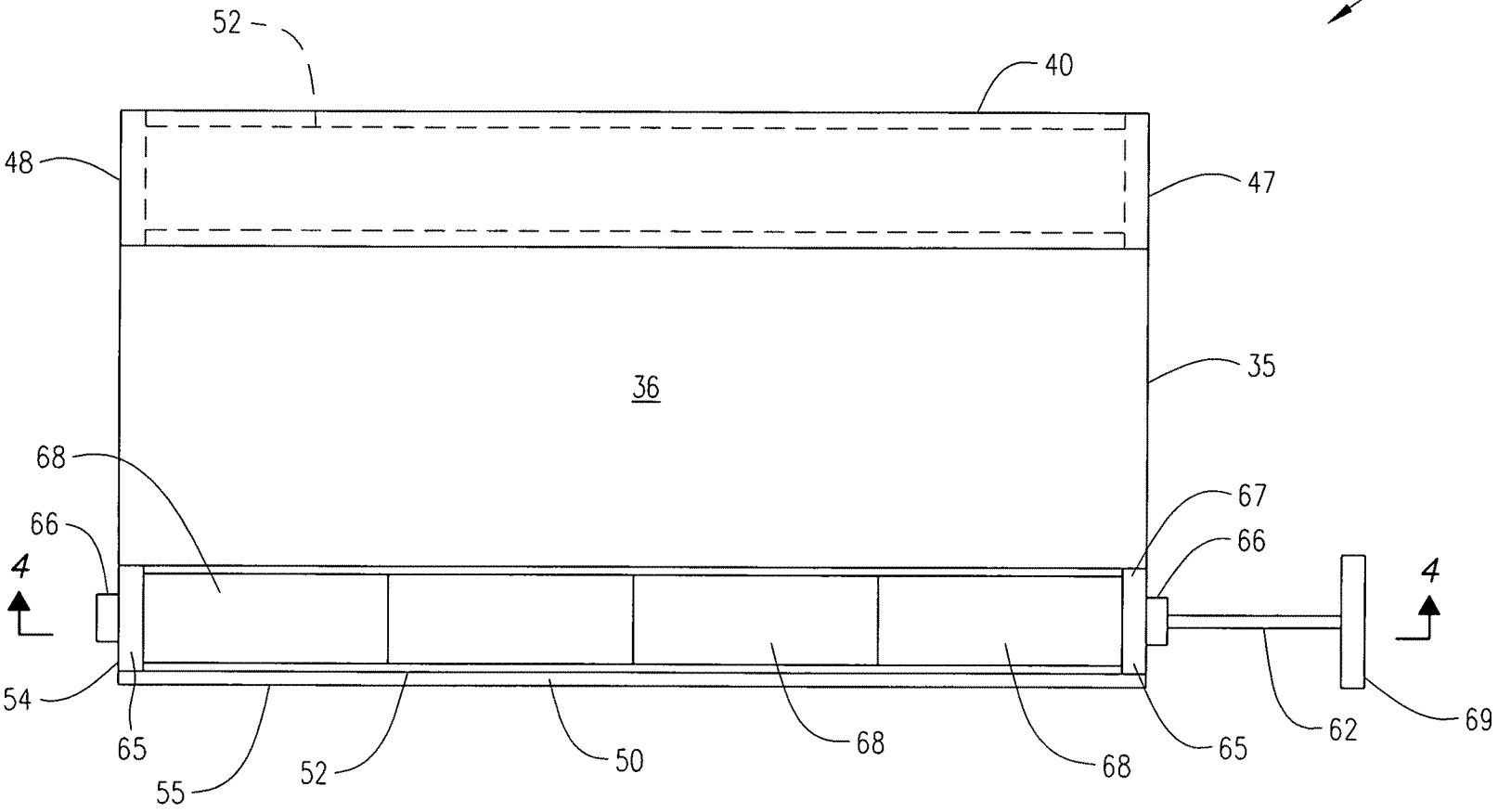
FIG. 3 is a cross sectional view of the magnetic roller bar, the outer bearings upon the roller bar axle and the outer drive pulley, along section lines 3/3 of FIG. 2.

Each magnetic cylinder chamber 52 receives and encloses a respective rotating magnetic rod assembly 60, FIG. 3, further defining a central rod 62 providing a short terminal end 63 and an extended terminal end 64, each end extending through an open end 54 of the magnetic cylinder chamber 52 and through a lateral side 24 of the sluice box 20 in a uniform orientation, with a plurality of cylindrical earth magnets 68 installed upon the rotating magnetic rod assembly 60 with opposing polar configurations, and a set of bearings 65 engaging the central rod 62 beyond the last of each row comprising the plurality of cylindrical earth magnets 68, at each short terminal end 63 and each extended terminal end 64, within each open end 54 of the magnetic cylinder tube chamber 52 and each respective lateral side 24 of the sluice box 20, each bearing forming a complete seal of each magnetic cylinder chamber 52. A drive pulley 69 attaches to each extended terminal end 64 of each central rod 62 beyond the respective lateral side 24 of the sluice box, and in axially alignment where there is more than one magnetic separator assembly 30. The central rod 62 turns freely within the respective bearings 65 along with the plurality of cylindrical earth magnets 68 rotating with it. The drive pulley 69 rotation compels the rotation of the central rod 62 outside the lateral side of the sluice, with drive pulley 69 rotation compelled by the common drive X.

When installed within the magnetic cylinder chamber 52 of the magnetic cylinder tube 50, an outer portion 66 of each bearing 65 engages a respective open end 54 of the magnetic cylinder chamber 52 either by insertion within the open end 54, FIG. 4, by installation upon the open end 54, or within the respective lateral side 24 of the sluice box 20. A bearing seal 67 is essential between the outer portion 66 of each bearing 65, the bearing seal 67 creating and air and water tight seal between the central rod 62 and the magnetic cylinder chamber 52 preventing any moisture or particulate materials to enter the magnetic cylinder chamber 52. Intrusion of contaminant particles will wear out the bearings 65 and eventually damage the central rod 62 and cylindrical earth magnets 68.

As the central rod 62 is turned by the common drive X that engages each drive pulley 69, a moving rotational magnetic field is created applied to an outer surface 55 around the magnetic cylinder chamber 52, which first uplifts magnetic particles A contained in the gold bearing sands B and moves them around the non-magnetic formed plate 35 passing them along the upper surface 38 towards the evacuation cylinder 40 where the vacuum occurring within the evacuation cylinder 40 sucks the magnetic particles A through the lower break 45 and passes them off for waste disposal through the evacuation hose 46. This separation and movement is demonstrated in FIG. 2.

Operation of the apparatus 10 occurs by selecting the angle and pitch of the sluice box 20 desired by the user based upon the particulate materials being separated and whether the application will use a wet or dry material process. The common drive X is then activated turning each of the at least one drive pulleys 69 to commence rotation and operation of each magnetic separator assembly 30, the drive pulleys 69 attaching a common drive belt W connected to the vertical axis common drive X. The gold bearing sands B are passed down the flat tray 22 of the sluice box 20, with each magnetic separator assembly 30 withdrawing a subsequent quantity of magnetic particles A from the passing gold bearing sands B, allowing the valuable non-magnetic gold bearing material C to pass below each magnetic separator assembly 30 unaffected by the magnetic fields. The materials A-C may be passed through the sluice box 20 as many times as desired by the user or until the user is satisfied that he has gained complete separation and evacuation of the majority of the magnetic particles, leaving behind a purified quantity of valuable non-magnetic gold bearing materials C.

As indicated in the specification above, the magnetic particles A of the gold bearing sands B is of little or no value. There are no precious metals that are magnetic. The valuable non-magnetic gold bearing materials C, including gold, thorium, titanium, tungsten, and zirconium, and gemstones including garnet, topaz, ruby, sapphire, and diamonds, are not removed by this present apparatus. These potentially valuable materials flow through the sluice box and are not eliminated by the magnetic separator assemblies 30 as they are passed below the lower surface 37 of the non-magnetic formed plate 35 where they are collected for further processing and classification.

An irrigation system 70 is further provided for optional "wet" application, FIGS. 1 and 2. Without the irrigations system 70, the process of separation is a "dry" separation. While the particulate mixture may be drawn from a wet source and contain moisture during the processing and separation, the apparatus may be operated without introducing more moisture to the process. Some user may prefer the dry application, which would generally require a greater pitch to the sluice box 20 during operation as would a wet application. The intent of the apparatus 10 is to allow the user to select the processing operation speed as well as to select between a wet or dry processing operation. The irrigation system 70 is further defined by a water tube 71 having a sealed end 72 and an open end 73 which orient parallel and in close proximity to the outer surface 55 of the magnetic cylinder chamber 52, each water tube 71 having perforations 74 or spray openings. The open end 73 of each water tube 71 is attached, preferably in series as shown in FIG. 1, to a primary water line 75, which may or may not include a valve regulator 76 for each respective water tube 71, the primary water line 75 perpendicular to each parallel water tube 71. The primary water line 75 is attached to a common water source Z. When water is supplied to each water tube 71, water is introduced to the particulate mixture, and is optimally directed, in part, towards the rotating magnetic field, or where the magnetic particles A are transfer from the magnetic cylinder tube 50 to the upper surface 38 of the middle planar portion 36 is occurring on the outer surface 55 of the magnetic cylinder tube, FIG. 2. This can wash the uptake particulate of dirt and dust and also wash away valuable non-magnetic gold bearing particles C which may cling to the magnetic particles A due to dirt or mud adhesion, washed away in the wet processing application as some point along the sluice box 20. The water also serves as a means of pushing the processed material down the sluice box 20, along with gravity used in the dry processing application. This may reduce the required angle desired by the user of the sluice box 20 during processing operations. It may also provide a more thorough separation of the valuable non-magnetic gold bearing materials C and magnetic particles A during processing operations.

Figure 5:
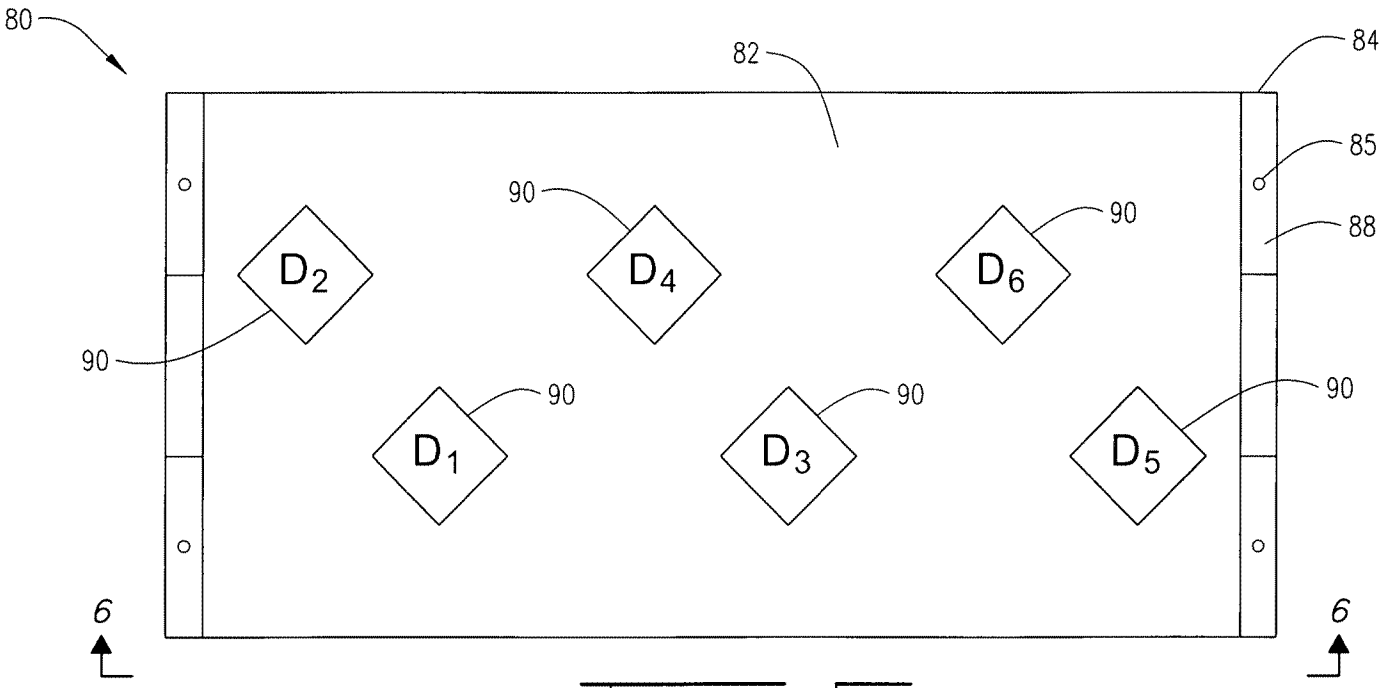
FIG. 5 is a top view of a plurality of the break elements within the particle scraper plates.
Figure 6:
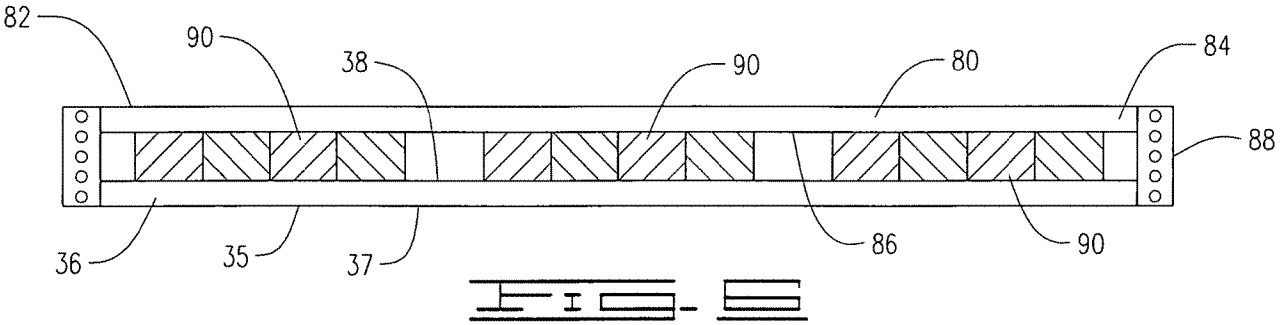
FIG. 6 is a front or rear view of the particle break elements within the particle scraper plates along section lines 6/6 of FIG. 5.

FIGS. 2 and 5-6 indicate a scraper and break assembly 80 which would be preferably applied to the upper surface 38 of the middle planar portion 36 of the formed plate 35, FIGS. 2 and 5-6. The attachment is shown by using threaded screws 85, FIG. 2, but the means of attachment may include adhesives or other means. However, it would be preferable that the attachment be removable, i.e. screws 85 as shown, in order to maintain and clean the apparatus and to remove any large material which might become stuck in the scraper and separator assembly 80. The scraper and separator assembly 80 defines an upper plate 82, lateral elevation supports 88 applied to each lateral portion 84 of the upper plate 82 between a lower surface 86 of the upper plate 82 and the upper surface 38 of the middle planar portion 36 of the formed plate 35 between the evacuation cylinder 40 and the water tube 71, above magnetic cylinder chamber 52, avoiding impediment to the lower break 45, also shown in FIG. 2. Between the lower surface 86 of the upper plate 82 and upper surface 38 of the middle planar portion 36 of the formed plate 35, a plurality of spaced shaped breakers 90 are included. These breakers 90 are shown a diamond shaped objects in FIGS. 2 and 5-6 and labeled D1-D6 for illustration purposes to indicate one preferred embodiment of their arrangement below the formed plate 35. Optimally, the thickness of each breaker 90 would be that of the distance between the upper plate 82 and the middle planar portion 36, with no space above of below each breaker 90.

The breakers 90 may be glued to the lower surface 86 of the upper plate 82, which would preferable provide contemporaneous breakdown of large clumps of the magnetic particles A by the breakers 90 during removal of the upper plate 82 for cleaning. It would also assure proper alignment of the breakers 90 upon reattachment of the upper plate 82 above the middle planer portion 36 subsequent to cleaning and prior to resumed processing. The breakers 90 are intended to disrupt the magnetic particles passed between the upper plate 82 and the middle planar portion 36 on its way to the lower break 45 of the evacuation cylinder 40, caused by particulate adhesion and surface tension of the moisture of the particulate material or due to the attraction of the particles while involved in the rotating magnetic field over the magnetic cylinder tube 50. They also function to reduce the area between the upper plate 82 and middle planar portion 36 to increase the effect of the vacuum force between the upper plate 82 and middle planar portion 36 towards the lower break 45. The diamond shaped breakers 90 and the illustrated placement in FIGS. 5-6 have been shown to produce optimal separation of the magnetic particles A prior to receipt within the lower break 45 of the evacuation cylinder 40, enhance the effect of the vacuum drawn through the lower break 45 into the evacuation hose 46, reduce clogging, clumping and clotting of the magnetic particles A and reduce the amount of processing stoppage and inconvenience while increasing productivity due to the presenting margins of the diamond shaped breakers 90 in more than one linear involvement.

Material selection of the components involved in the magnetic separator apparatus 10 would be primarily non-magnetic materials, including plastic, aluminum and other non-magnetic materials. In addition, the magnetic separator apparatus 10 is contemplated for use in an ore processing assembly, which would contemplate use with further sluice separation components subsequent to the magnetic separator apparatus 10, preliminary gross separation components, and other additional separation, classification and ore processing devices or components as chosen by the user. It is therefore contemplated that it may be a component in an otherwise larger processing system. It may be stationary or portable. Although the embodiments of the magnetic separator apparatus 10 have been described and shown above, it will be appreciated by those skilled in the art that numerous modifications may be made therein without departing from the scope of the invention as herein described.

I claim:

1. A magnetic separator apparatus for the removal of magnetic particulate materials from gold bearing sands and passing valuable non-magnetic gold bearing materials along the apparatus without removal, applied to wet or dry use, the magnetic separator apparatus comprising:

a sluice box defining a lower flat tray and a pair of lateral sides;

at least one magnetic separator assembly defining a non-magnetic formed plate having a middle planar portion with an upper surface and a lower surface, each said at least one magnetic separator assembly secured between said lateral sides of said sluice box;

a cylindrical evacuation cylinder formed within said non-magnetic formed plate, said evacuation cylinder defining a lower break opening to said upper surface of said middle planar portion, said evacuation cylinder further defining a closed end and an open end attaching an evacuation hose creating a vacuum with said evacuation cylinder and said lower break by a vacuum source further attaching to said evacuation hose;

a magnetic cylinder tube formed within said non-magnetic formed plate defining a magnetic cylinder chamber with open ends and having an outer surface;

a rotating magnetic rod assembly inserting with said magnetic cylinder chamber, said magnetic rod assembly defining a central rod with a short terminal end and an extended terminal end, between which attach a plurality of cylindrical strong earth magnets in alternating polar orientation, said rotating magnetic rod assembly extending through said lateral said of said sluice box and sealing within said magnetic cylinder chamber by a bearing and seal installed within each said open end and surrounding said respective short terminal end and said extended terminal end, with said extended terminal end further attaching a drive pulley outside said lateral side of said sluice box, said drive pulley further attaching by a drive belt to a vertical axis common drive; and a scraper break assembly defining an upper plate with a lower surface and lateral portions attached by two or more threaded screw to respective lower elevation supports above said middle planar portion of said non-magnetic formed plate, wherein said gold bearing sands are passed along the flat tray of the sluice box, each said at least one magnetic separator assembly lifting said magnetic particles contained in said gold bearing sands along said outer surface of said magnetic cylinder tube by the magnetic field created by the rotating magnetic rod assembly and passing said magnetic particles over said upper surface of said middle planar portion and passing said magnetic particles into said lower break of said evacuation tube to be eliminated by said vacuum source for disposal while said valuable non-magnetic gold bearing materials are passed down said flat tray of said sluice box below said lower surface of said middle planar portion for collection and further classification.

2. The magnetic separator assembly of claim 1, further comprising:

an irrigation system providing at least one water tube defining a sealed end and an open end and at least one linear perforation directed toward said outer surface of said magnetic cylinder tube, said open end of said water tube attaching to an external water source by a primary water line, said irrigation system providing water through said at least one perforation to wash away non-magnetic particles which may be integrated within said magnetic particles back into said sluice box and to provide a residual flow of water to said sluice box to move said valuable non-magnetic gold bearing materials down said sluice box.

3. The magnetic separator assembly of claim 1, further comprising:

an irrigation system providing at least one water tube defining a sealed end and an open end and at least one linear perforation directed toward said outer surface of said magnetic cylinder tube, said open end of said water tube attaching to an external water source through a valve regulator installed within a primary water line providing the user a choice between a wet or dry application, said irrigation system providing water through said at least one perforation to wash away non-magnetic particles which may be integrated within said magnetic particles back into said sluice box and to provide a residual flow of water to said sluice box to move said valuable non-magnetic gold bearing materials down said sluice box.

4. The magnetic separator assembly of claim 1, further comprising:

a plurality of shaped breakers attaching to said lower surface of said upper plate to reduce clogging, clumping and clotting of said magnetic particles, reduce processing stoppage and inconvenience and increasing productivity due to presenting said shaped breakers in a non-linear orientation.

* * * * *